US005941388A

United States Patent [19]

Spielberger

[11] Patent Number: 5,941,388

[45] Date of Patent: Aug. 24, 1999

[54] CHRISTMAS LIGHT STORAGE SYSTEM

[76] Inventor: William L. Spielberger, 1019-A Waterwood Pkwy., Edmond, Okla. 73034

[21] Appl. No.: 09/085,236

[22] Filed: May 27, 1998

[51] Int. Cl.[6] ..... B65D 85/42

[52] U.S. Cl. ..... 206/419; 206/495; 206/702; 242/598.5; 53/430

[58] Field of Search ..... 206/419, 420, 206/421, 422, 702, 707, 388, 495; 242/598.5, 598.6, 513.3; 53/430, 116

[56] References Cited

U.S. PATENT DOCUMENTS

| | | | |
|---|---|---|---|
| 2,592,939 | 4/1952 | Miller | 242/613.3 |
| 3,878,941 | 4/1975 | Kelner | 206/419 |
| 4,025,039 | 5/1977 | Croll et al. | 229/27 |
| 4,478,331 | 10/1984 | Ruin | 206/707 |
| 5,033,619 | 7/1991 | Garis | 206/419 |
| 5,064,067 | 11/1991 | McAllister et al. | 206/420 |
| 5,121,838 | 6/1992 | Dickie | 206/334 |
| 5,123,534 | 6/1992 | Chwang | 206/419 |
| 5,152,395 | 10/1992 | Cross | 206/389 |
| 5,317,491 | 5/1994 | Lee | 206/421 |
| 5,513,081 | 4/1996 | Byers | 362/145 |
| 5,526,931 | 6/1996 | White | 206/420 |
| 5,529,187 | 6/1996 | DeNola | 206/449 |
| 5,551,773 | 9/1996 | Cottrell | 242/598.4 |
| 5,653,339 | 8/1997 | Dobson | 206/420 |
| 5,661,953 | 9/1997 | Jolley | 53/430 |

*Primary Examiner*—Paul T. Sewell
*Assistant Examiner*—J. Mohandesi
*Attorney, Agent, or Firm*—Robert Treece

[57] ABSTRACT

A Christmas light storage system having a container with a lid, a plurality of racks, and a tower. The tower attaches to the container to provide a stable base, and individual racks attach to the tower to allow a strand of lights stored on the rack to be removed. The racks may be oscillating or compartmentalized racks, with the oscillating racks holding at least one strand of lights on each of the two sides of the rack. When removing the lights from the oscillating rack, one end of a strand of lights is pulled and the rack osculates or rocks back and forth to release the lights. The compartmentalized racks include individual compartments for each light bulb on a strand of lights. The compartmentalized rack may be attached to the tower so that an end of a strand of lights may be pulled to remove the entire strand from the rack. Both the oscillating and the compartmentalized racks include means for securing and separating the racks when stored in the container.

10 Claims, 4 Drawing Sheets

CHRISTMAS LIGHT STORAGE SYSTEM

BACKGROUND OF THE INVENTION

1. Field of the Invention

The present invention relates to racks and containers for storing strands of Christmas lights from year to year. More particularly, the present invention relates to racks for holding strands of lights and containers for storing the racks.

2. Description of the Prior Art

Before the current invention, prior Christmas light storage devices have left the user with a tangled, time consuming mess when it was time to retrieve and reinstall strands of lights. Some of the better devices provided frames onto which one or more strands of light could be wrapped. This caused several problems when it was time to remove the lights from the frame, such as tangled or hung strands, twisted wires, and broken bulbs.

With the prior art devices a strand of lights often became entangled when on the rack since the bulb from one wrap around the frame would catch on the frame or the bulbs and/or wire from a prior wrap around the frame. When removing the strand from the rack, it required the user to hold the frame in one hand while untangling and placing the removed part of the strand with the other. Since the user was required to stay with the frame it was necessary to carefully place the unwrapped portion of the strand so that it would not become tangled after removal.

In addition, the lights were wrapped around the prior storage frames causing the strands of lights to twist as they were put onto, or removed from, the frame. This often caused the strand to kink up due to the many twists that accumulate while wrapping or unwrapping the string. Another problem related to this twisting was that strands of two or more twisted wires would become untwisted. This made the strand look bad and often made the strand hard to neatly install on a house or the like. Yet another problem related to the twisting was that when one tried to remove kinks or re-twist the strand, the bulbs were often banged against the ground or floor while the untwisting was done. This would loosen or break bulbs, causing the strand not to light. These prior devices also required the user to unwrap the string of lights while at the same time trying to lay out the string so it would not become tangled after removal from the frame.

Some prior devices provided a means for rotatingly attaching the frame so the string of lights could be pulled from one end, which was intended to allow the user to pull the lights from the rotating frames. However, these devices included many of the problems listed above as well as additional disadvantages. For example, since the string of lights was wound around the frame, the bulbs from one wrap often become hooked with another wrap or the frame itself. This required the user stay with the frame and release the hooked bulb.

Even if the user took great care when wrapping a strand onto a rotatable frame, the strand was likely to tangle when pulling the strand to unroll it. One common way for a tangle to occur was similar to a backlash on a fishing reel; that is, when pulling the line the rotating frame builds momentum, and when the user quits pulling the frame continues to rotate. When this happened, the strand would either pile up on the ground where it could tangle or wind backward on the frame causing a tangle.

BRIEF SUMMARY OF THE INVENTION

In view of the foregoing disadvantages inherent in the known types of storage devices for Christmas lights now present in the prior art, the present invention provides new and improved construction wherein the same can be utilized reliably in those situations where easy storage and use of Christmas lights is desired. As such, the general purpose of the present invention, which will be described subsequently in greater detail, is to provide a new and improved Christmas storage rack and container which has all the advantages of the prior art storage devices and none of the disadvantages.

To attain this, the present invention essentially comprises a plurality of racks which may be oscillatable racks or compartmentalized racks. A stand or tower is provided for mounting the racks when removing the strand of lights, and a storage container may also be provided for storing the racks.

Each oscillatable rack will store separate contentious strands of lights, on opposite sides of the rack. The individual racks may be mounted on a tower such that the rack will oscillate, or rock back and forth, when removing a strand of lights from one side of the rack.

The compartmentalized racks include a plurality of compartments, or pigeon holes. The lights are stored by inserting the light bulbs one after another into adjacent compartments. In this way the bulbs are protected and cannot tangle with other bulbs or the wire. To remove the bulbs one need only grasp the end of the strand and start pulling.

The rack or tower is for mounting either an oscillatable rack or a compartment rack in a position where one can take the end of a strand and pull it to remove the strand from the rack. Preferably the rack is attachable to the storage container so the container will provide a stable base for the tower, and reduce the number of pieces required to build the rack.

The apparatus may also include a storage container having means, such as slots, for keeping individual racks separated when stored therein. Preferably the storage container is sealable to prevent dust, insects and the like away from the lights when they are stored therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Christmas light storage system which may be easily and efficiently manufactured and marketed.

It is a further object of the present invention to provide a new and improved Christmas light storage system which is of a durable and reliable construction.

An even further object of the present invention is to provide a new and improved Christmas light storage system which is susceptible of a low cost of manufacture with regard to both materials and labor, and which accordingly is then susceptible of low prices of sale to the consuming public, thereby making such system economically available to the buying public.

Still another object of the present invention is to provide a new and improved Christmas light storage system which provides some of the advantages of the prior art, while simultaneously overcoming some of the disadvantages normally associated therewith.

Another object of the present invention is to provide a new and improved Christmas light storage system to reduce or eliminate twisting and tangling of a strand of lights when stored or removed from storage.

Yet another object of the present invention is to provide a new and improved Christmas light storage system which allows one to remove a strand of lights from a storage rack by pulling one end of the strand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a sectional view of the compartmentalized light strand rack of FIG. 5.

DETAILED DESCRIPTION OF THE PREFERRED EMBODIMENTS

Figure 1:
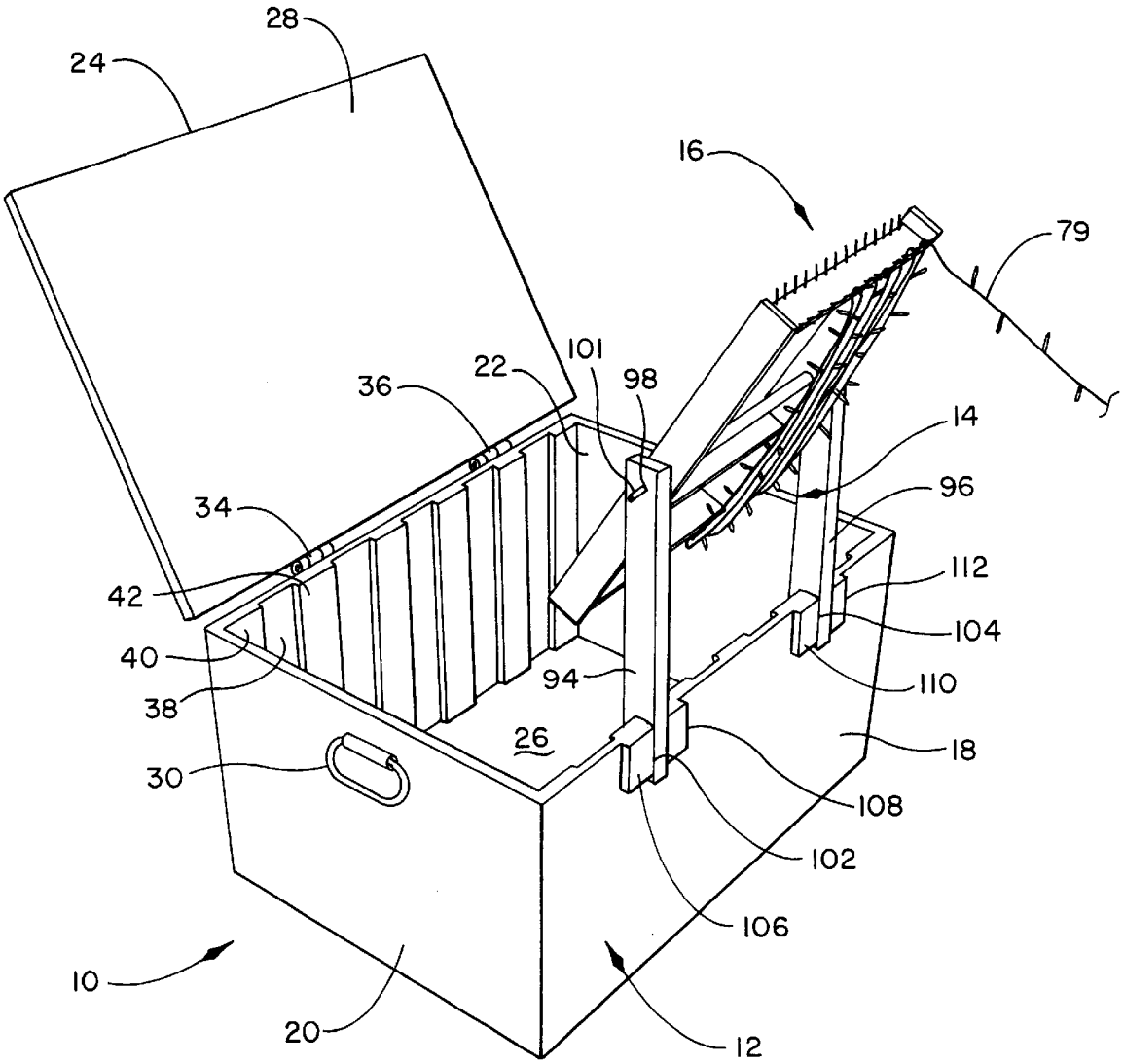
FIG. 1 is a perspective view of a Christmas light storage system constructed in accordance with the present invention configured for removing lights from the system.

Referring to the drawings in detail and to FIG. 1 in particular, reference character 10 generally designates a Christmas light storage system constructed in accordance with the present invention. The storage system 10 includes a container 12, a removable stand 14 and light racks, an oscillating light strand rack, being designated by the reference character 16. Other types of racks will be discussed below with reference to other figures.

The container 12 preferably has a front side 18, a left side 20, a right side 22, a back 24 and a bottom 26. The sides, the back and the bottom are preferably permanently connected and may even be integral. A top may also be provided so the container may be closed and even sealed for storage. Since the container may be used to store Christmas lights for extended periods of time, the various container parts are preferably connected in a manner to prevent rodents, insects, spiders, and dust from entering the container when it is stored. Thus, while the sides, front, back and bottom may be made from separate pieces and then connected to form the container, preferably the sides front, back and bottom are integral. For the same reason the preferred embodiment has no apertures in the sides, front, back or bottom, and there are preferably no apertures or openings where the various pieces meet.

A top 28 is preferably provided to close or even seal the container for storage. As is shown in the figures, the top 28 may be connected to the container such as by hinges 34 and 36. But in an alternate, preferred embodiment the top 28 may snap or lay on to close the container. The snap type top is generally preferred when the container and top are made from a moldable material such as plastic. It should be noted however, that the container 12 and top 28 may be made of any durable material suitable for storage, such as plastic, wood, cardboard, or the like.

Handles, such as left handle 30 and right handle 32 (shown in FIG. 2), may be provided to make it easier to move the container from one location to another, such as when carrying the container from its storage location to a location where Christmas lights will be installed or taken down. Handles 30 and 32 are preferably pivotally attached to decrease the amount of storage room needed for the container. If, however, a moldable material such as plastic is used, the handles may be molded into the container itself thereby reducing the total number of separate pieces needed to construct the container.

Since the container serves as a storage container for racks onto which Christmas light may be attached, means is provided in the container for securing the racks. One such suitable means is a series of alternating grooves and ridges on opposing interior walls of the container such as groove 38 and ridges 40 and 42 with the corresponding opposing groove 44 and ridges 46 and 48.

Figure 2:
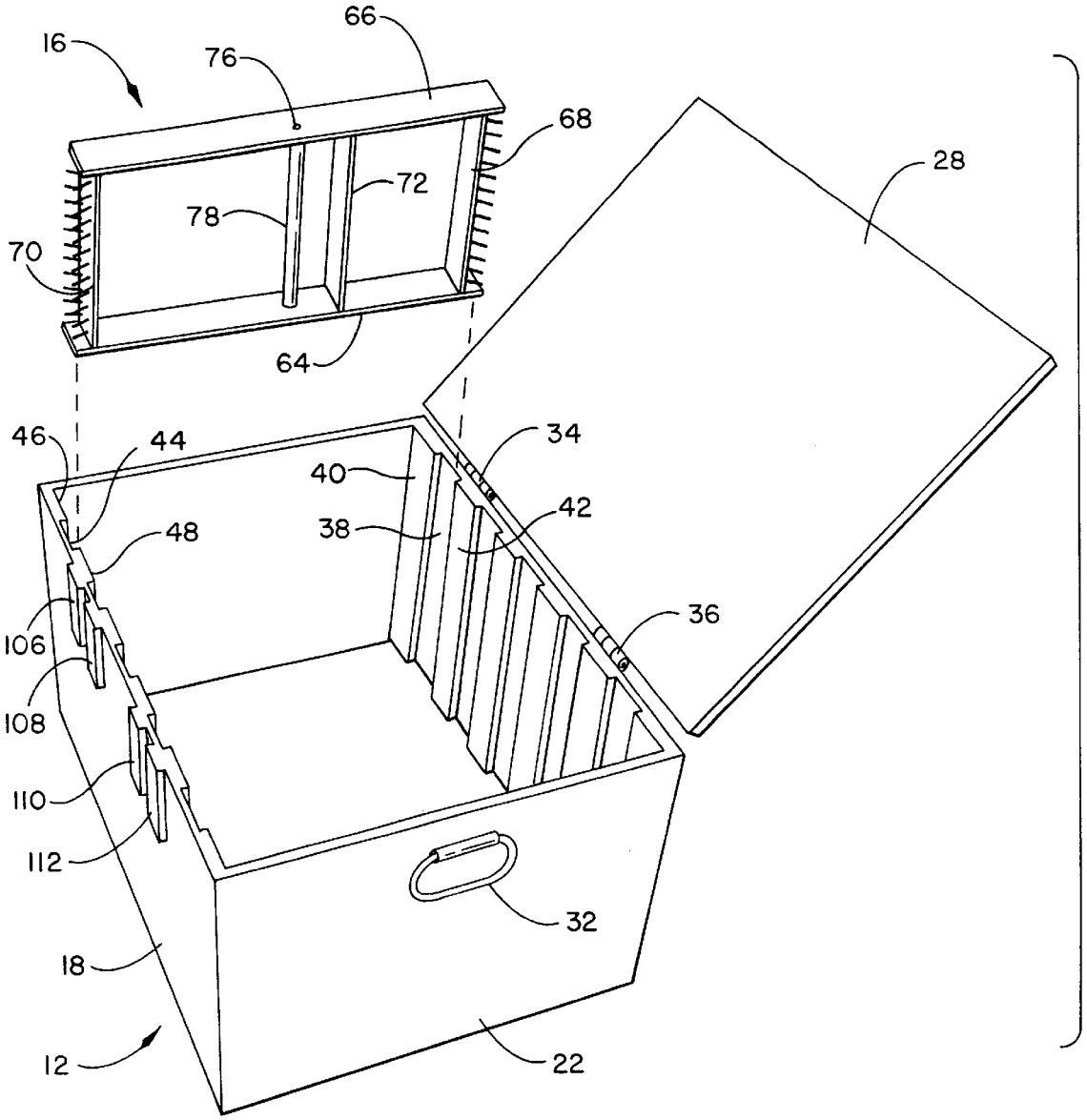
FIG. 2 is another perspective view of a the Christmas light storage system of FIG. 1, showing the insertion of a rack.

As shown in FIG. 2, an oscillating rack 16 can then be placed in the container 12 in a pair of the groves (such as groves 38 and 44) to secure the rack within the container. In this way, several racks may be secured in the container while keeping the racks, and any lights thereon, separated.

Figures 3, 4, 5:
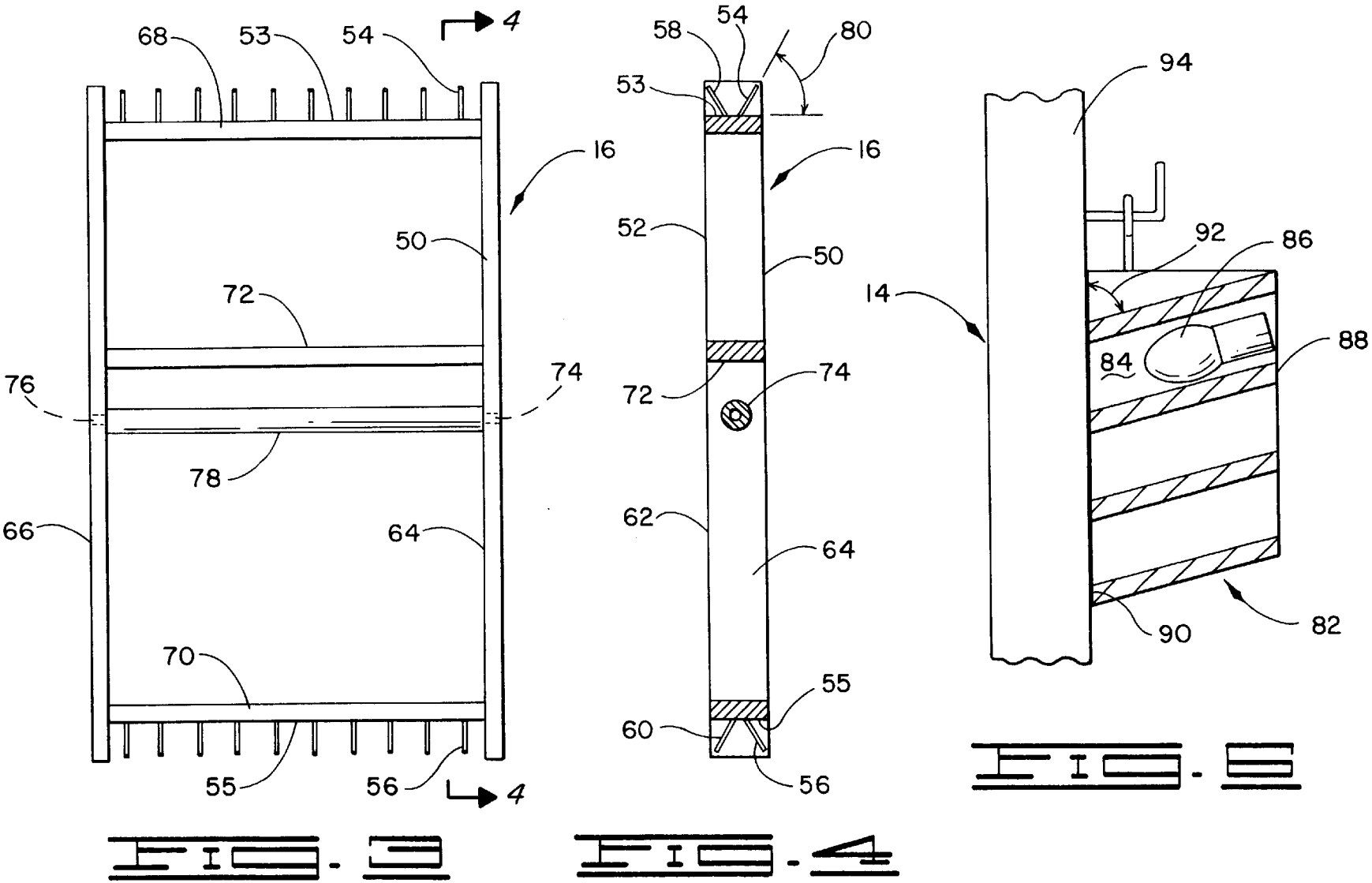
FIG. 3 is a frontal view of an oscillating light strand rack for use with the Christmas light storage system of FIG. 1.
FIG. 4 is a sectional view of the oscillating light strand rack of FIG. 3.
FIG. 5 is a perspective view of a compartmentalized light strand rack for use with the Christmas Light storage system of FIG. 1.
Figure 5:
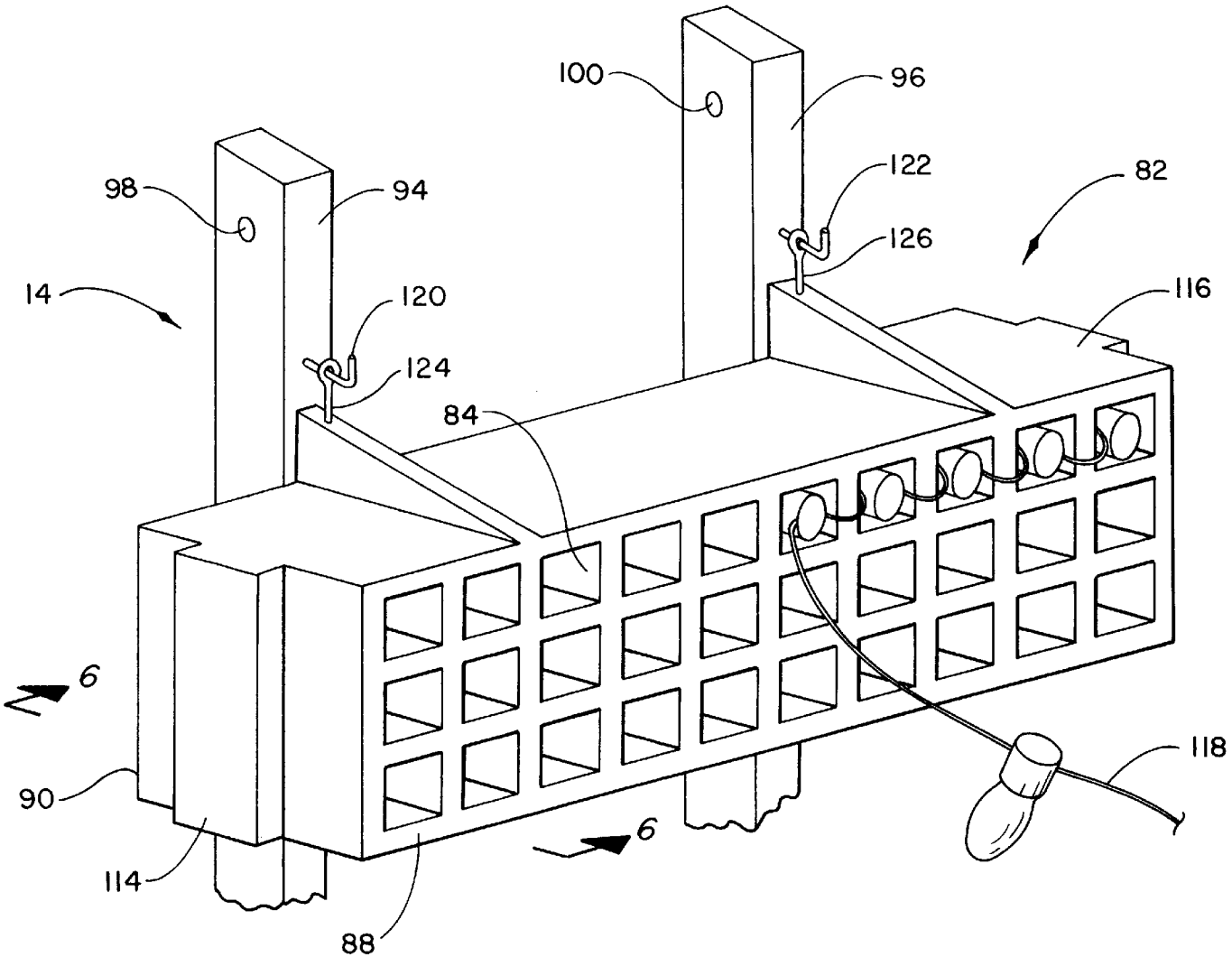

Referring now to FIGS. 3 and 4, shown therein is an enlarged view of a suitable oscillating rack 16. The rack 16 has a first side 50 and a second side 52 and is generally a frame 62 with first and second ends (53 and 55) for supporting rows of angled pegs, such as pegs 54, 56, 58 and 60.

The frame 62 may be constructed in various ways, provided it includes supports for the rows of angled pegs, and is sized to slide into the groves in the container 16 for secure storage. By way of example, the frame 16 includes side members 64, and 66; end members 68 and 70; and brace 72. Oscillating means is provided for mounting the rack 16 on a tower and allowing the rack to osculate. The oscillating means is utilized when unweaving lights from the rack. One suitable oscillating means may include stand 14, and a pair of apertures 74 and 76, which will be discussed in detail below. A conduit 78 may also be provided between apertures 74 and 76.

As shown in FIG. 3, apertures 74 and 76 are generally centered between the rack ends 68 and 70. This allows the rack 16 to be mounted in the stand 14 without considering which end of the rack is the top and the bottom. Since the rack 16 osculates instead of rotating on the stand, the apertures may be placed closer or further from one end of the rack. However, if the apertures are moved too close to an end of the rack, it will be difficult to cause the rack to osculate when pulling a strand of lights 79 from the rack.

The rows of pegs are placed at an obtuse angle to the adjacent side. For example, the angle 80 between peg 54 and first side 50 is preferably greater than 90 degrees and less than 180 degrees; more preferably the angle 80 is between 130 degrees and 170 degrees; and most preferably the angle 80 is about 150 degrees. The angle 80 thus helps hold a strand of lights onto the rack 16 when they are on the first side 50. Each row of pegs is placed with a similar angle, while the angles could vary from row to row. By making the angles generally the same, the rack is easier to manufacture.

It should also be noted that while the rows of pegs are shown in general alignment (that is peg 54 and peg 58 are aligned in the top view of FIG. 3) the pegs may be place in a staggered arrangement where pegs 54 and 58 would not be aligned in a top view.

A stand 14 is provided to facilitate the removal of a strand of lights from the racks. In general the stand needs a stable base and means for pivotally attaching the rack to the stand. It should be noted that while the stand 14 shown is attached to the container other stable bases may be provided. It has been found, however, that the number of pieces may be reduced by using the container as the base. The means for pivotally attaching the rack may also be accomplished in several ways, the preferred embodiment being a left and right post 94 and 96, with each post having an aperture 98 and 100 (FIG. 5). A dowel rod 101 not shown can then be inserted through aperture 98 in the left post 94, though apertures 74 and 76 in the frame 16 and then through aperture 100 in the right post 96. As discussed above, conduit 78 may be provided to guide the dowel rod 101 through the frame, and thereby make it easier to insert the dowel. Once the dowel rod 101 is inserted, the frame 16 can then rock back and forth with the dowel serving as a point of pivot or axis. Some other suitable means for pivotally attaching the rack include, but are not limited to, protrusions on either the rack or posts with matching concaves for the protrusions to slip into.

One suitable way to attach the posts 94 and 96 to the container 12 is by placing slots 102 and 104 over an edge of the container. Proper spacing and alignment of the post may be accomplished by providing stops 106, 108, 110 and 112 on the container. In this way the posts 94 and 96 are held the proper distance apart.

FIGS. 5 and 6 show a compartmentalized rack 82 which may be used with the Christmas light storage system 10. The compartmentalized rack 82 has a plurality of compartments like compartment 84. Each compartment is designed to hold an individual light, such as light 86 from a strand of lights. While three rows of ten compartments are shown in the drawings, the number of rows and/or the number of columns may be varied to provide sufficient compartments for strands of lights having different numbers of bulbs. Preferably the compartments are placed on a slant with the front 88 or side where the bulbs are inserted elevated in relation to the back 90. The preferred amount of elevation is represented by angle 92 (FIG. 6) which is about 75 degrees. This gives each compartment about a 15 degree slant which helps hold the bulbs in place. In addition the size of the compartments should be slightly larger than the bulbs so that the wires are biased against the sides of the compartment to also help hold the bulbs in place.

Preferably the compartmentalized rack 82 also includes means for securing the rack 82 in the container 12 for storage. One such suitable means includes protrusions 114 and 116. The protrusions 114 and 116 are sized and shaped to slide into the groves 38 and 44 (FIG. 2) to hold the rack 82 in place in the container 12. Means is also provided to facilitate the removal of a strand of lights 118 from the rack 82. One suitable means is the use of hook and eye attachment (such as hooks 120 and 122; and eyes 124 and 126) to the rack 14.

In operation, when storing a strand of lights 79 on the oscillating rack 16 the strand of lights is woven onto a single side of the rack. This is accomplished by hooking one end of the strand to the rack and then weaving the lights on to the rows of pegs on that side of the rack. Referring to FIG. 3, and by way of example, one end of the strand of lights may be hooked to peg 54 and then the strand is hooked around peg 56 and then back up and around the peg next to peg 54. This procedure is repeated until the entire strand is woven onto the rack. A second strand of light may then be woven onto the opposite side of the rack.

After the lights are on the rack, the rack may then be stored in the container by sliding the rack into groves in the container. As is shown in FIG. 2, once the rack is in the container the groves and ridges hold the rack in place. Then other racks may be loaded with lights and stored in the container in other groves. This will keep the lights and the racks separate to prevent tangling of the lights while in storage.

Compartmentalized racks may also be stored in the container. To load a strand of lights 118 into the compartmentalized rack 82, lights are simply pushed into the compartments sequentially. It has been found on light strands where the wires extend from the side of the base, such as strand 118, a slight twist of the socket after inserting into a compartment further biases the wire against the compartment and more firmly holds the light. The loaded rack is then slid into the container so that it is held in place by the mating arrangement of the protrusions 114 and 116 with the groves and ridges in the container.

The lid of the container is then closed and the container may be stored without concern that the light strands will become tangled. Additionally, the container serves to keep the lights clean and free from pests.

When it is time to remove the lights from the container, one need only open the container and remove a rack, set up the tower with the rack and start pulling the lights from the rack. The rack is set up by sliding posts 94 and 96 over an edge of the container. An oscillating rack is then attached by sliding dowel rod 101 through the posts and the rack. The one end of the strand of lights is pulled and the rack will osculate, or rock back and forth while the lights are released from the rack. If a compartmentalized rack such as rack 82 is used, it may be connected to the tower 14 by hanging the rack from the tower with the hooks and eyes. One need only grasp one end of the strand of lights 118 and pull. In this way, the lights will be removed from the compartments one at a time. Once all the desired lights have been removed, the racks may be replaced in the container with the tower and stored until needed.

Changes may be made in the combinations, operations, methods and arrangements of the various parts, steps and elements described herein without departing from the spirit and scope of the invention as defined in the following claims.

I claim:

1. A Christmas light storage system comprising:

at least one rack, each of the racks having a first and a second side, said rack for holding at least one strand of lights wherein means on the first side of each of the racks holds at least one strand of lights, and means on the second side of each of the racks holds at least one strand of lights; wherein the racks each have a first end and a second end; wherein each end includes at least one row of angled pegs secured to the rack at an obtuse angle to the adjacent side, a tower for connecting to a base and to at least one of the racks, for holding a rack while removing the strand of lights from the rack;

a means for pivotally and removably connecting said racks, one at a time, to the tower so that a rack attached to said tower rack oscillates when a strand of lights is being removed from the rack.

2. The Christmas light storage system of claim 1 wherein said base is a container for storing at least one rack; and a lid for closing said container when storing at least one rack.

3. The Christmas light storage system of claim 2 wherein the container has opposing interior walls which include a plurality of alternating grooves and ridges for mating engagement with at least one rack when said racks are stored in said container to hold said racks while stored.

4. The Christmas light storage system of claim 1 wherein the obtuse angle is at least 130 degrees and not greater than 170 degrees.

5. The Christmas light storage system of claim 1 wherein the tower comprises two posts, each post connected to the base and removably and pivotally connected to a rack to allow the rack to oscillate when a strand of lights is being removed from the rack.

6. The Christmas light storage system of claim 1 wherein said tower comprises at least two posts, each post having an aperture therein, wherein said rack includes first and second sides, each side having an aperture therein, and wherein the means for pivotally and removably connecting said racks comprises a dowel rod inserted through the apertures in each post and the apertures in the rack.

7. The Christmas light storage system of claim 1 wherein the racks each have a first end and a second end; wherein each end includes at least one row of angled pegs secured to the rack at an obtuse angle to the adjacent side; wherein the first side of each of the racks holds at least one strand of lights, and the second side of each of the racks holds at least one strand of lights; wherein a rack is pivotally connected to the tower so the rack oscillates when a strand of lights is being removed from the rack; and wherein the base comprises a container for storing the racks when said racks are not connected to said tower.

8. A method for removing a strand of lights from a Christmas light storage container comprising the steps of:

attaching a tower having first and second posts to said Christmas light storage container;

removing a rack from the storage container, said rack having a first and a second side and at least one strand of lights connected to one of either the first and second sides;

pivotally attaching said rack to said tower by inserting a dowel through an aperture in said first post, through said rack and through an aperture in said second post;

grasping and pulling one end of said strand of lights to cause the rack to oscillate and release the strand of lights from said rack.

9. The method of claim 8 wherein the step of attaching the tower to the storage container comprises: sliding said tower onto an edge of said container so that a portion of said tower is inside said container and a portion of said tower is outside said container.

10. The method of claim 9 wherein the step of removing a rack from the storage container comprises sliding the rack up out of the container from between ridges inside the container.

* * * * *